US006621994B1

(12) United States Patent
Yamada et al.

(10) Patent No.: US 6,621,994 B1
(45) Date of Patent: Sep. 16, 2003

(54) CONTROLLER WHICH CONTROLS POWER SUPPLY OF ELECTRICAL MACHINERY AND APPARATUS CONNECTED TO ANOTHER EQUIPMENT

(75) Inventors: Hiroshi Yamada, Toyokawa (JP); Kazuhiro Araki, Okazaki (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 08/888,284

(22) Filed: Jul. 3, 1997

(30) Foreign Application Priority Data

Jul. 10, 1996 (JP) ..... 8-180479

(51) Int. Cl.[7] ..... G03G 15/00
(52) U.S. Cl. ..... 399/88
(58) Field of Search ..... 399/1, 37, 70, 399/88, 90; 358/296, 401, 501, 434, 443

(56) References Cited

U.S. PATENT DOCUMENTS 4,133,420 A * 1/1979 McManus ..... 355/18
4,308,941 A * 1/1982 Rist et al. ..... 355/15
4,615,609 A * 10/1986 Honma ..... 355/14 R
4,870,526 A 9/1989 Maruta et al.
5,316,124 A * 5/1994 Barnes et al. ..... 382/7
5,457,516 A * 10/1995 Kim ..... 355/208
5,528,346 A * 6/1996 Kim et al. ..... 355/204
5,592,034 A * 1/1997 Felmus et al. ..... 307/130
5,760,494 A * 6/1998 Takeda ..... 399/37

FOREIGN PATENT DOCUMENTS

| | | |
|---|---|---|
| JP | 55-95140 | 7/1980 |
| JP | 60-20689 | 2/1985 |
| JP | 2-55247 | 4/1990 |
| JP | 7-44067 | 2/1995 |

* cited by examiner

*Primary Examiner*—Adolf D. Berhane
(74) *Attorney, Agent, or Firm*—Burns, Doane, Swecker & Mathis, LLP

(57) ABSTRACT

Determination is made as to whether a vendor (an apparatus which allows use of a copying machine according to the value of any money entered) is connected to a copying machine having a power supply to be controlled. If the vendor is connected to the copying machine, an automatic power off function is inhibited. When the power supply is turned off, if any coin is entered in the vendor, the supply is automatically turned on.

26 Claims, 8 Drawing Sheets

CONTROLLER WHICH CONTROLS POWER SUPPLY OF ELECTRICAL MACHINERY AND APPARATUS CONNECTED TO ANOTHER EQUIPMENT

BACKGROUND OF THE INVENTION

1. Field of the Invention

The present invention relates to a power supply controller, and more particularly relates to a power supply controller which can appropriately control the power supply of the electrical machinery or apparatus when another equipment is connected to the electrical machinery or apparatus to be controlled.

2. Description of the Related Art

Conventionally, a controller which controls the power supply of the electrical machinery or apparatus (hereinafter referred to just as electrical apparatus) is provided. Some controllers automatically turn on or off the power supply of the electrical apparatus at a prescribed timing. Generally such controllers automatically turn on or off the power supply when a preset time has arrived. On the other hand, some controllers turn off the power supply when no manipulation of the electrical apparatus or operation according to the manipulation is carried out for a prescribed period. The latter controllers are particularly applied to an image formation apparatus such as a copying machine.

On the other hand, a vendor is provided which is connected to the electrical apparatus and used. The vendor allows the use of the electrical apparatus according to the value entered in itself. Generally a coin or prepaid card is used as the value entered in the vendor.

If the controller automatically turning on or off the power supply of the electrical apparatus and the vendor are simultaneously applied to the electrical apparatus, the problems described in the following (1) and (2) occur.

(1) When the vendor is connected to the electrical apparatus, if the controller turns off the power supply of the electrical apparatus, the user needs to turn on the supply of the apparatus again.

(2) When the power is supplied from the electrical apparatus to the vendor, if the power supply of the electrical apparatus is turned off, the power supply of the vendor is also turned off. A trouble which occurs in this case is that even if there is any balance of the value entered in the vendor, the balance becomes ineffective.

SUMMARY OF THE INVENTION

The present invention is made to solve the problems described above. An object of the invention is to improve ease of use of a controller for the power supply of an electrical apparatus to be controlled.

Another object of the invention is to effectively control the electrical apparatus to which a vendor is connected.

According to one aspect of the invention, a controller which controls the power supply of an electrical apparatus determines whether another apparatus is connected to the electrical apparatus, and changes details of the control of the power supply according to the result of the determination.

According to another aspect of the invention, a controller, which controls the power supply of an electrical apparatus to which a vendor allowing the use of the electrical apparatus according to an entered value is connected, determines whether there is any balance of the value entered in the vendor, and changes details of the control of the power supply according to the result of the determination.

According to still another aspect of the invention, a controller, which controls the power supply of an electrical apparatus to which a vendor allowing the use of the electrical apparatus according to an entered value is connected, determines whether any value is entered in the vendor, and changes details of the control of the power supply according to the result of the determination.

According to still another aspect of the invention, an image formation apparatus having an automatic power-off function which allows the power supply to be automatically turned off at a prescribed timing includes: a determination circuit which determines whether a vendor allowing the use of the image formation apparatus according to a value entered in the image formation apparatus is connected or not; and a control circuit which inhibits the power supply from being turned off by the automatic power-off function if the determination circuit determines that a vendor is connected to the image formation apparatus.

According to still another aspect of the invention, an image formation apparatus to which a vendor allowing the use of the image formation apparatus according to an entered value and which has the automatic power-off function which allows the power supply to be automatically turned off at a prescribed timing includes: a determination circuit which determines whether there is any balance of the value entered in the vendor; and a control circuit which inhibits the power supply from being turned off by the automatic power-off function if the determination circuit determines there is any balance in the vendor.

According to still another aspect of the invention, an image formation apparatus to which a vendor allowing the use of the image formation apparatus according to an entered value is connected and which has the automatic power-off function which allows the power supply to be automatically turned off at a prescribed timing includes: a determination circuit which determines whether any value is entered in the vendor and a control circuit which allows the power supply of the image formation apparatus to be turned on if the determination circuit determines that some value is entered in the vendor.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment in which the invention is applied to an electrophotographic copying machine is described in detail referring to the attached figures. Although the electrophotographic copying machine is mentioned as one example of an electric apparatus to be controlled, the invention can be applied to any apparatus which is driven by the electric power.

Figure 1:
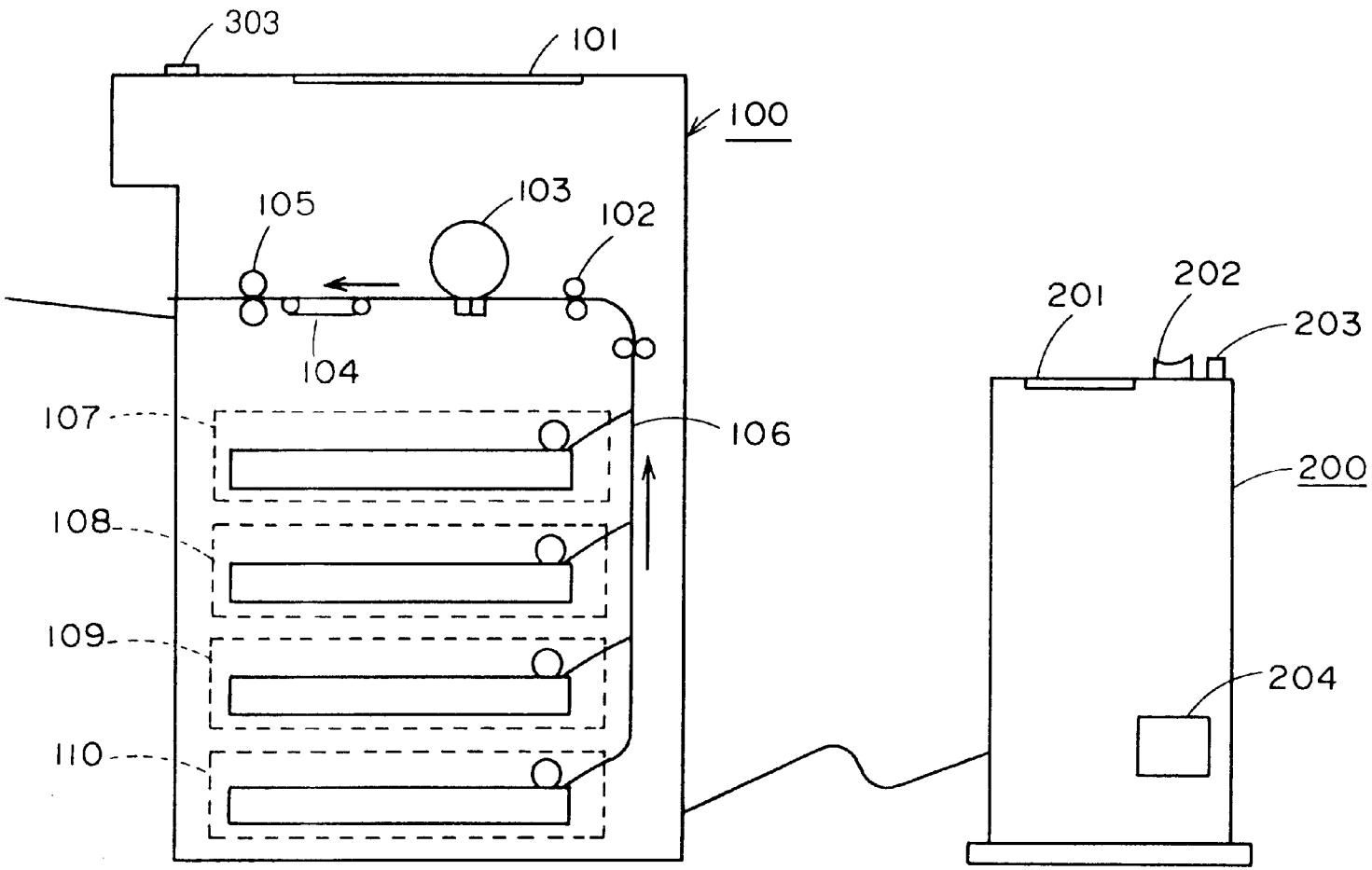
FIG. 1 illustrates structures of a copying machine and a coin vendor connected thereto according to the first embodiment of the present invention.

FIG. 1 shows a schematic cross section of an electrophotographic copying machine (hereinafter referred to just as copying machine) 100 and a schematic view of a coin vendor 200 connected to copying machine 100 according to the first embodiment of the invention.

The structure of copying machine 100 is basically similar to the conventional electrophotographic copying machine. Specifically, a photoreceptor drum 103 which is rotatably driven is placed at a central portion of copying machine 100. Several units such as a main eraser lamp, a transfer charger, an image edge eraser lamp, a developing device, a transfer charger, a copy paper separation charger, and a cleaning unit (not shown) are provided around the photoreceptor drum. Photoreceptor drum 103 is illuminated by the eraser lamp per one transfer and charged by the corona charger. The front and rear edges of an image area are discharged by the image edge eraser lamp, and the image is exposed to the photoreceptor drum 103 by means of an optical system.

Copying machine 100 includes automatic paper feed cassettes 107–110 provided at respective paper feed outlets. Copy papers in the automatic paper feed cassettes are selectively provided by respective feed rollers into copying machine 100, passed through a paper path 106, transported to a timing roller pair 102 in a pressed state, and temporarily held there.

At the transfer, a toner image on photoreceptor drum 103 is transferred to a copy sheet fed by timing roller pair 102 by corona discharging of the transfer charger at a transfer portion. The copy sheet is then separated from photoreceptor drum 103 by the corona discharging of the separation charger and the resiliency of the copy paper itself. The copy paper is attracted onto a transport belt 104 having air suction means and, at the same time, transported leftward with respect to the plane of the figure following rotation of belt 104.

The transported copy paper is passed through a fixing unit 105 and the toner image is fused and fixed, and the copy paper is discharged from copying machine 100.

Coin vendor 200 is connected to copying machine 100 and used. When any coin is entered in coin vendor 200, it allows sheets of the number corresponding to the entered value to be copied. It is noted that coin vendor 200 may allow the copying according to any bank note, prepaid card and the like entered therein. Management of the copying machine by such a vendor is known, and description of its details is omitted.

Coin vendor 200 includes a display portion 201 on which any balance of the entered coin is displayed, a coin slot 202 for inserting a coin therein, a coin return button 203 for returning the entered coin, and a coin return outlet 204 for discharging the coin to be returned.

Figure 2:
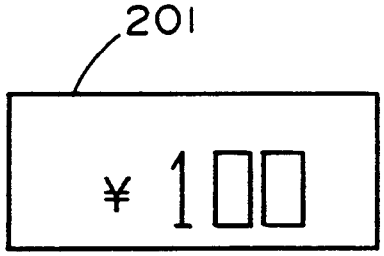
FIG. 2 shows one specific example of the content of the display on a display portion 201 of FIG. 1.

FIG. 2 shows one example of the display on display portion 201 of coin vendor 200.

Figure 3:
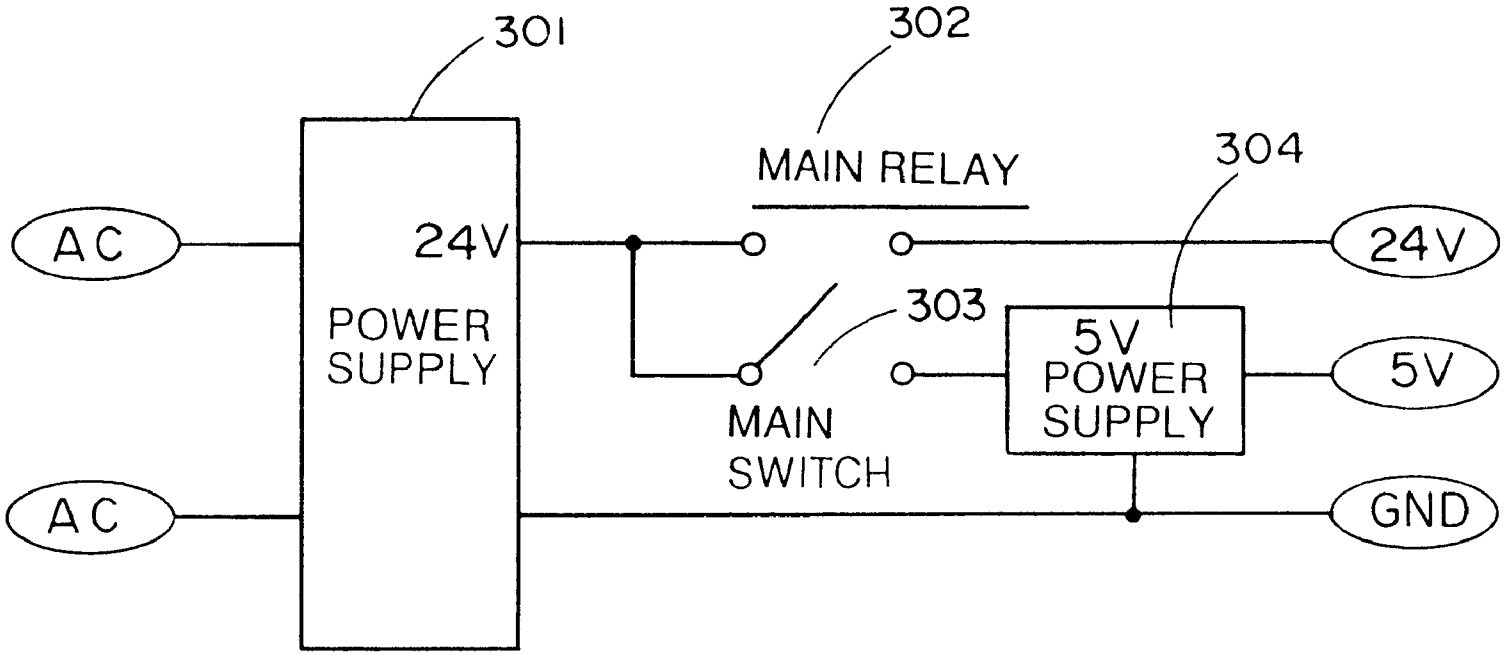
FIG. 3 is a block diagram showing a structure of a power supply circuit included in the copying machine 100 of FIG. 1.

FIG. 3 is a block diagram showing schematically a power supply portion of copying machine 100.

Referring to FIG. 3, the power supply portion includes a power supply control portion (24V power supply) 301 for controlling the supply voltage input from an alternating current power supply AC, a main switch 303 provided at the copying machine body, a main relay 302 controlled by a CPU in copying machine 100, and a control portion (5V power supply) 304 for converting the voltage of 24V output from power supply control portion 301 via main switch 303 to the voltage of 5V.

By turning on or off main relay 302 which is controlled by the CPU, the power supply of copying machine 100 can be turned on or off, or a power saving mode of copying machine 100 can be made operable or not.

Figure 4:
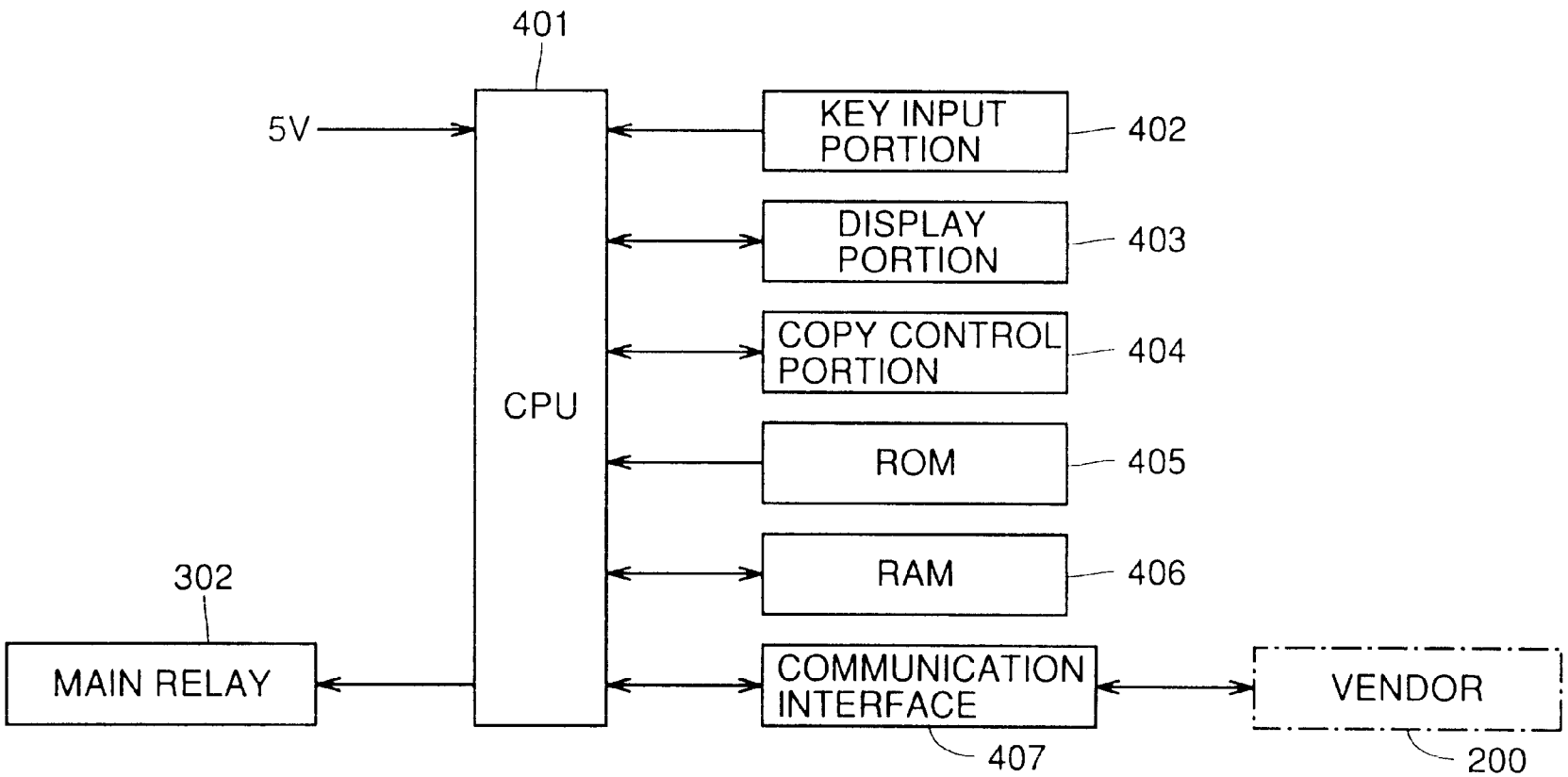
FIG. 4 is a block diagram showing a structure of a control circuit included in the copying machine 100 of FIG. 1.

FIG. 4 is a block diagram showing a structure of a circuit at the periphery of the CPU of copying machine 100.

With reference to FIG. 4, the components connected to a CPU 401 are: a key input portion 402 constituted by a ten key, a start key and the like; a display portion 403 which displays the state of the copying machine, its mode and the like; a copy control portion 404 which controls feeding of copy sheets, exposure, development, transfer, fixing and the like; an ROM 405 in which a control program, for example, is written; an RAM 406 constituted by a non-volatile memory and stores control data and the like; and a communication interface 407 which provides and receives information to and from coin vendor 200 concerning the number of sheets to be copied, the sheet size, discharging of the sheet, the state of the connection of the vendor, the presence/absence of any coin and the like. CPU 401 operates according to the program written in ROM 405.

A power supply of 5V is provided to CPU 401. CPU 401 transmits a control signal to main relay 302 thereby turning on/off the power supply of copying machine 100.

Figure 5:
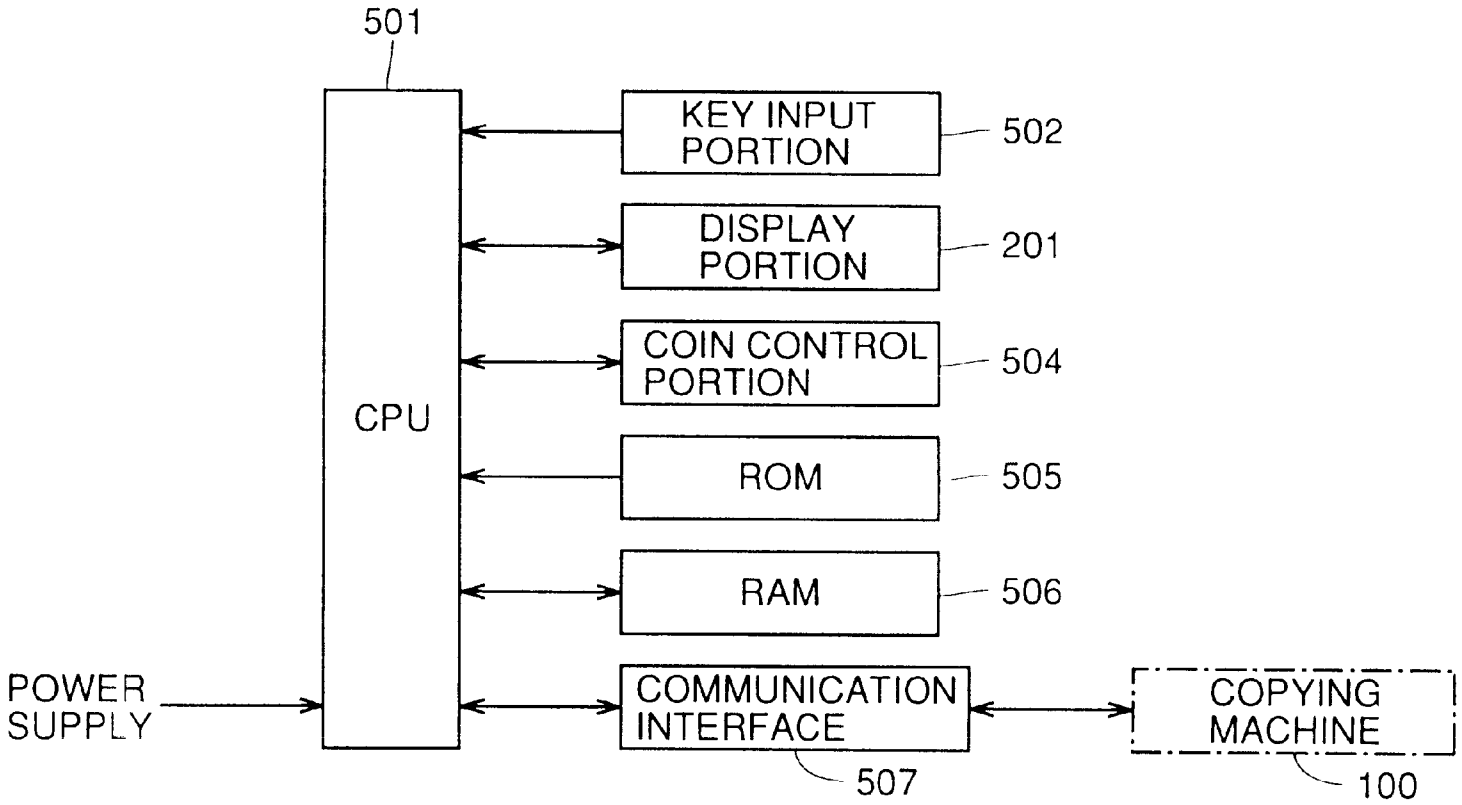
FIG. 5 is a block diagram of a control circuit included in a coin vendor 200 of FIG. 1.

FIG. 5 is a block diagram illustrating a structure of a circuit at the periphery of the CPU of coin vendor 200.

With reference to FIG. 5, the components connected to a CPU 501 are: a key input portion 502 constituted by a coin return button 203 and the like; a display portion 201 which displays the balance of any entered coin; a coin control portion 504 which controls the entered coin or any coin to be returned; an ROM 505 which stores a program for controlling coin vendor 200; an RAM 506 constituted by a non-volatile memory and stores control data and the like; and a communication interface 507 which provides and receives information to and from copying machine 100 concerning the number of sheets to be copied, the sheet size, discharging of the sheet, the state of connection of the vendor, presence/absence of any coin, and the like.

CPU 501 carries out an operation based on the program stored in ROM 505.

It is noted that coin vendor 200 is supplied with electric power from copying machine 100.

Figure 6:
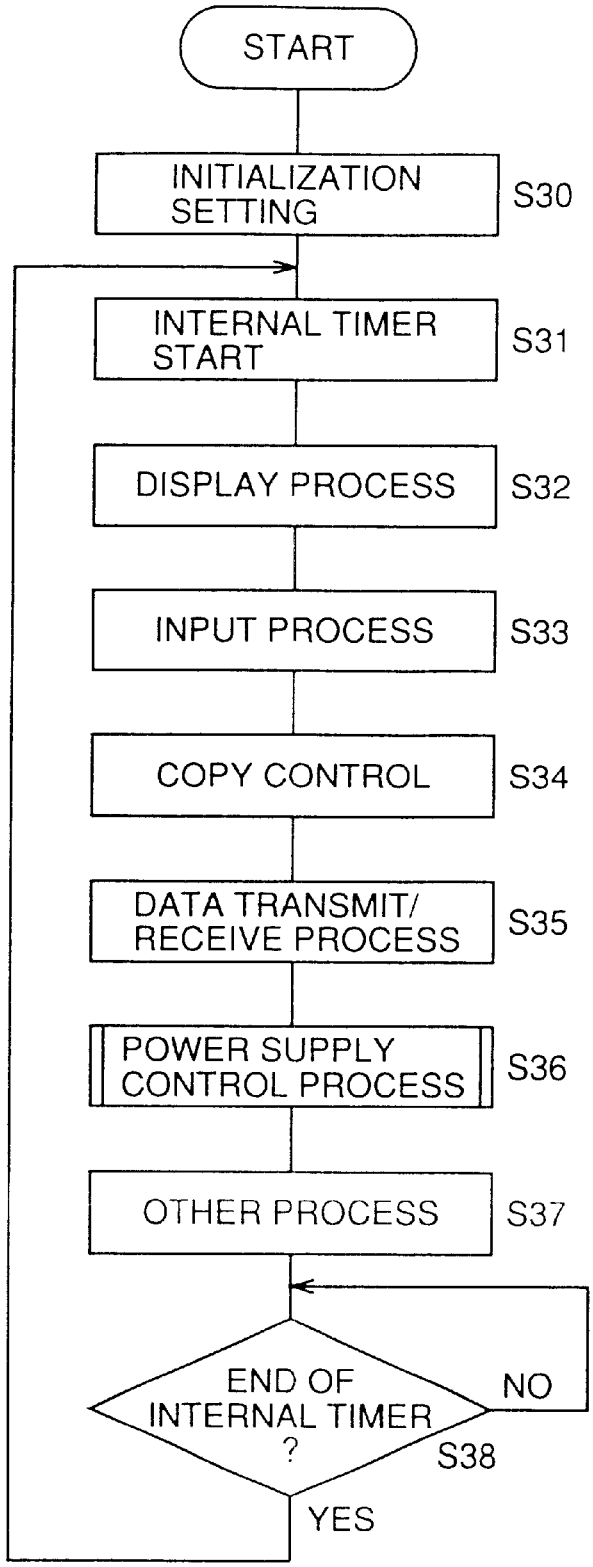
FIG. 6 is a flow chart showing the process carried out by a CPU 401 of FIG. 4.

FIG. 6 is a flow chart schematically showing the processing carried out by CPU 401 shown in FIG. 4.

With reference to FIG. 6, when the CPU is reset (e.g. by turning on the power supply or a reset button) and execution of a program is started, initializing of the CPU such as clearing of the RAM, setting of various registers and the like is carried out (step S30). At this time, an initial value of TSET is set as a count value TIME of an automatic power off timer. An internal timer which is contained in the CPU and in which the count value is set in advance at the initialization thereafter starts (step S31).

Next, various subroutine processes necessary for the copying process are executed. Specifically, a display process (step S32), an input process (step S33), copy control (step S34), a process of transmitting and receiving data to and from the vendor (step S35), a process of controlling turning on/off of the power supply (step S36), and other processes (step S37) are successively performed.

After all of the subroutine processes are completed, one routine completes when the counting of the initially set internal timer ends (step S38), and the processing returns to the step S31. Counting of various timers employed in respective subroutines is carried out using the length of time of this one routine.

Figure 7:
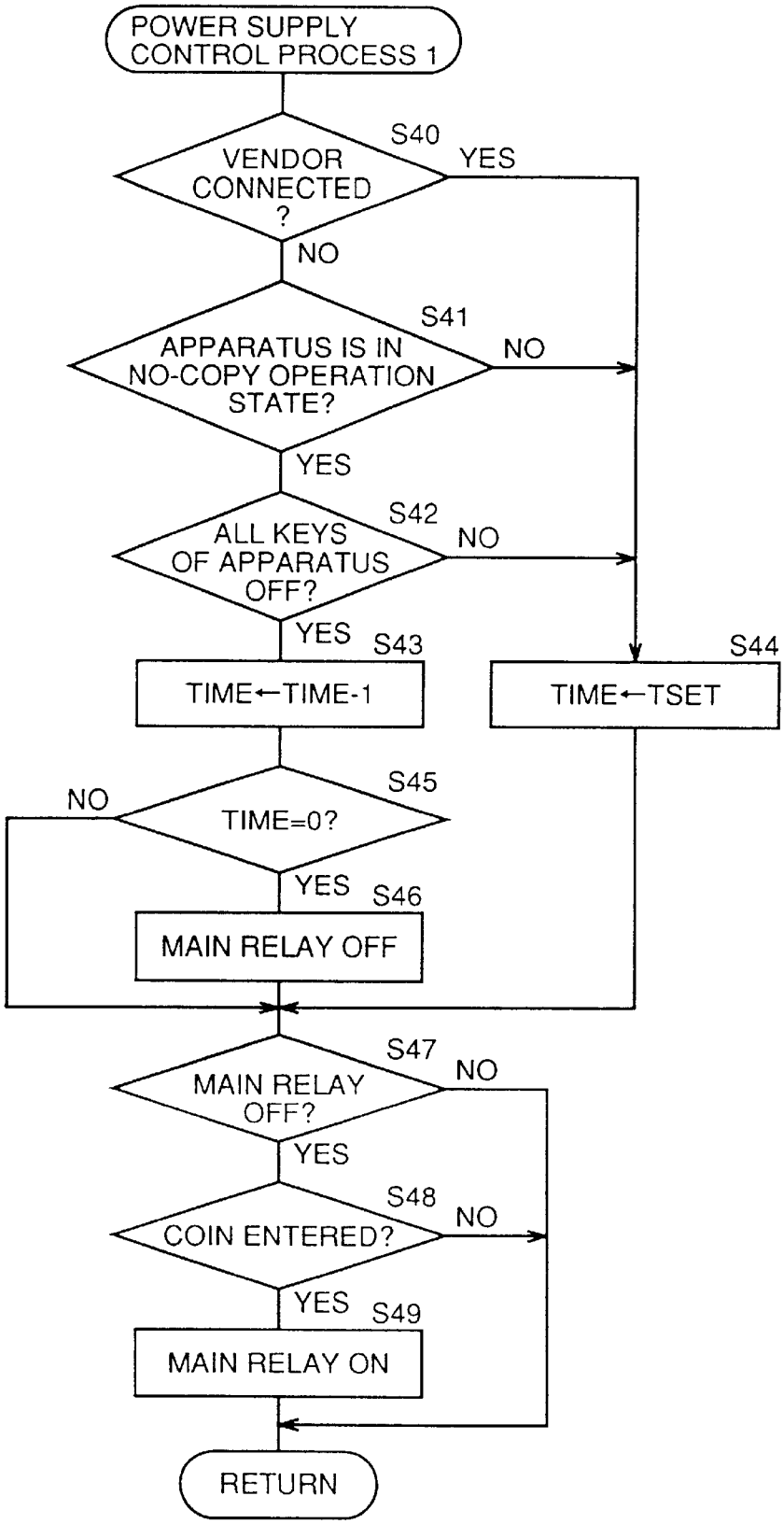
FIG. 7 is a flow chart showing the process carried out in a power supply control process (S36) shown in FIG. 6.

FIG. 7 is a flow chart showing specific processes carried out in the power supply control process (step S36) in FIG. 6.

Referring to FIG. 7, whether coin vendor 200 is connected to copying machine 100 or not is determined in step S40. Specifically, this determination can be made by detecting if a connector of the vendor 200 is connected to copying machine 100 or not, or transmitting and receiving a signal via communication interfaces 407 and 507.

If NO in step S40 (coin vendor 200 is not connected), it is determined whether copying machine 100 is in no-copying operation state or not in step S41. If YES (copying operation is not proceeding) in step S41, whether all of the keys of copying machine 100 are off or not is determined in step S42. If YES in step S42, the count value TIME of the automatic power off timer is counted down by one (step S43). Whether TIME is zero or not is determined in step S45. If YES, the power supply of copying machine 100 is turned off by turning off relay 302 in step S46.

Next in step S47, whether main relay 302 is turned off or not is determined. If YES, whether any coin is entered in coin vendor 200 or not is determined in step S48.

If YES in step S48, the main relay is turned on and the power supply of copying machine 100 is accordingly turned on in step S49.

If YES in the step S40, or NO in the step S41 or the step S42, initial value TSET which is preset as a value of TIME is set in step S44. Processes starting from step S47 are thereafter carried out.

If NO in the step S45, processes are carried out starting from step S47.

If NO in either the step S47 or the S48, the process is completed.

Copying machine 100 according to this embodiment is provided with the automatic power off function which allows the power supply of the copying machine to be automatically turned off when manipulation or key input by an user and a copying operation based on such manipulation are not carried out for a prescribed period. Whether vendor 200 is connected to copying machine 100 or not is determined. If connected, the automatic power off function is inhibited thereby controlling to prevent the power supply from being turned off.

When the main relay is turned off (the power supply is turned off by the automatic power off function), if any coin is entered in coin vendor 200, the main relay is automatically tuned on. Accordingly, the user can utilize copying machine 100 just by entering a coin without turning on the power supply of copying machine 100 again, so that ease of use of the copying machine can be improved.

Figure 8:
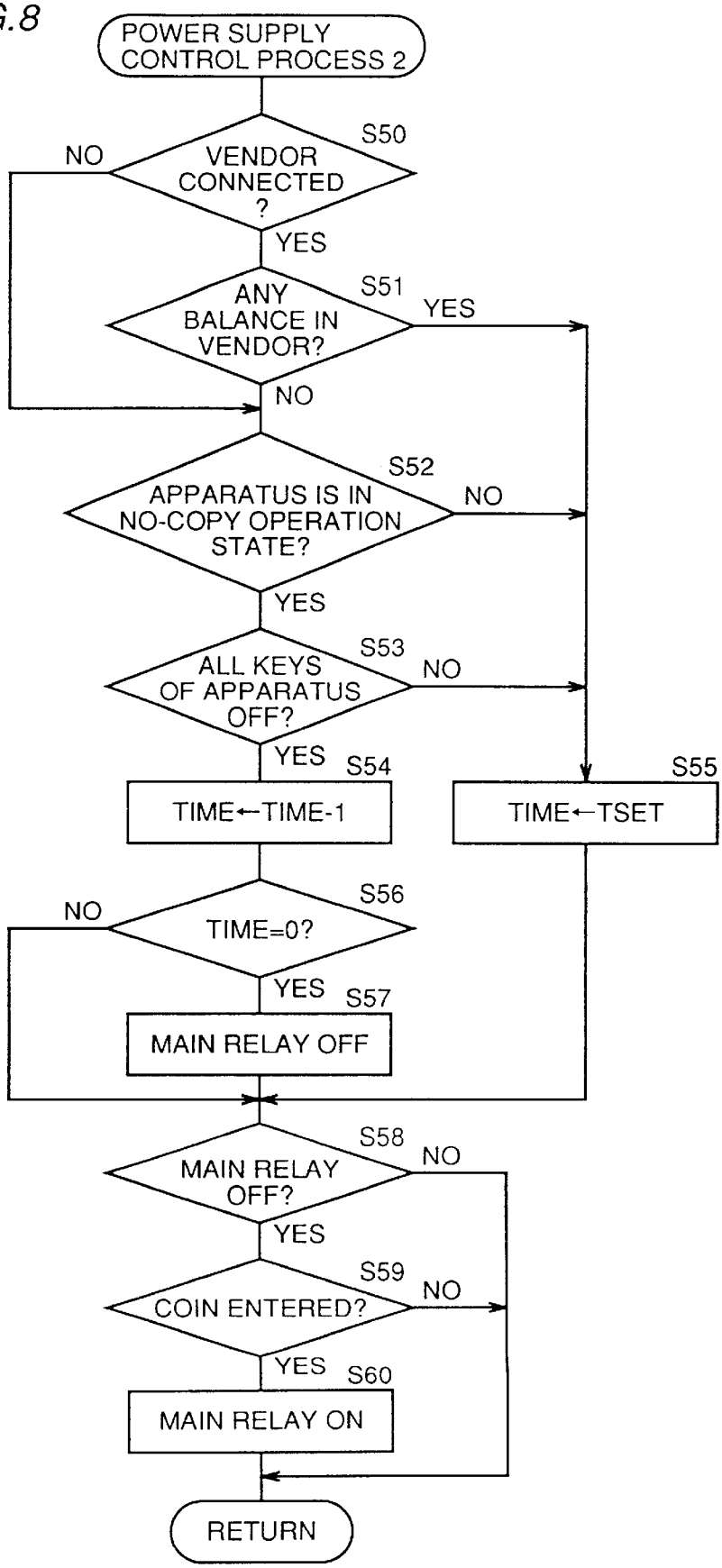
FIG. 8 is a flow chart showing a modification of the flow chart shown in FIG. 7.

FIG. 8 is a flow chart showing a variation of the flow chart in FIG. 7.

With reference to FIG. 8, a difference between the flow chart in FIG. 8 and that in FIG. 7 is that whether vendor 200 is connected or not is determined in step S50, and if YES, whether there is any balance in vendor 200 is determined in step S51.

If YES in step S51, the process is started from step S55, and if NO, the process is started from step S52.

If NO in step S50, the process starting from step S52 is carried out.

Since the processes carried out in the steps S41 to S49 in FIG. 7 respectively correspond to those from S52 to S60 in FIG. 8, description thereof is omitted.

According to the flow chart shown in FIG. 8, the automatic power off function is controlled so that it does not function only when there remains any balance in vendor 200. Therefore, the trouble can be avoided in which the power supply is turned off by the automatic power off function and the balance is canceled even if there is any balance in the vendor 200.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A controller for controlling a power supply of an electrical apparatus, said controller determining whether a separate apparatus is connected to said electrical apparatus or not, and changing details of the control of said power supply according to a result of the determination.

2. The controller according to claim 1, wherein said separate apparatus is a vendor which allows use of said electrical apparatus according to any value entered therein.

3. The controller according to claim 2, said controller controls such that said power supply of the electrical apparatus is automatically turned off at a prescribed timing, and inhibits the power supply from automatically turned off by said control if said controller determines said vendor is connected to said electrical apparatus.

4. The controller according to claim 2, wherein said vendor is supplied with electric power from said electrical apparatus.

5. A controller for controlling an electrical apparatus to which a vendor allowing use of the electrical apparatus according to any value entered therein is connected, said controller determining if there is any balance of the value entered in said vendor, and changing details of the control of said power supply according to a result of the determination.

6. The controller according to claim 5, said controller controlling such that said power supply of the electrical apparatus is automatically turned off at a prescribed timing, and inhibiting the power supply from turned off by said control if said controller determines there is any balance of the value in said vendor.

7. The controller according to claim 6, said controller turning on said power supply of the electrical apparatus if any value is entered in said vendor when said power supply of the electrical apparatus is turned off by said control.

8. The controller according to claim 6, wherein said vendor is supplied with electric power from said electrical apparatus.

9. The controller according to claim 5, wherein said electrical apparatus includes an automatic power off function and said controller changes details of the automatic power off function according to whether there is any balance of the value entered in said vendor.

10. The controller according to claim 6, wherein said controller allows the power supply to be turned off by said control when said balance of the value in said vendor has been consumed.

11. A controller for controlling a power supply of an electrical apparatus to which a vendor allowing use of the electrical apparatus according to any value entered therein is connected, said controller determining whether any value is entered in said vendor, and changing details of control of said power supply when value is entered in said vendor.

12. The controller according to claim 11, said controller turning on said power supply of the electrical apparatus if it determines that any value is entered in said vendor.

13. The controller according to claim 11, wherein said vendor is supplied with electric power from said electrical apparatus.

14. The controller according to claim 11, wherein said electrical apparatus includes an automatic power off function and said controller changes details of the automatic power off function according to whether any value is entered in said vendor.

15. An image formation apparatus having an automatic power off function which allows a power supply to be turned off automatically at a prescribed timing, comprising:

determination means for determining whether a vendor allowing use of said image formation apparatus according to any value entered therein is connected or not; and control means for inhibiting the power supply from turned off by said automatic power off function if said determination means determines that said vendor is connected.

16. The image formation apparatus according to claim 15, wherein said vendor is supplied with electric power from said image formation apparatus.

17. An image formation apparatus to which a vendor allowing use of said image formation apparatus according to any value entered therein is connected, and which has an automatic power off function which allows a power supply to be turned off automatically at a prescribed timing, comprising:

determination means for determining whether there is any balance of the value entered in said vendor; and control means for inhibiting the power supply from turned off by said automatic power off function if said determination means determines there is any balance of the value in said vendor.

18. The image formation apparatus according to claim 17, wherein said control means turns on said power supply of the image formation apparatus if any value is entered in said vendor when said power supply of the image formation apparatus is turned off by said automatic power off function.

19. The image formation apparatus according to claim 17, wherein said vendor is supplied with electric power from said image formation apparatus.

20. The image formation apparatus according to claim 17, wherein said control means allows the power supply to be turned off by said automatic power off function when said balance of the value in said vendor has been consumed.

21. An image formation apparatus to which a vendor allowing use of said image formation apparatus according to any value entered therein is connected, and which has an automatic power off function which allows a power supply to be turned off automatically at a prescribed timing, comprising:

determination means for determining whether any value is entered in said vendor; and control means for turning on said power supply of the image formation apparatus when said determination means determines any value is entered in said vendor.

22. The image formation apparatus according to claim 21, wherein said vendor is supplied with electric power from said image formation apparatus.

23. A method of controlling an image formation apparatus having an automatic power off function which allows a power supply to be turned off automatically at a prescribed timing, comprising the steps of:

1) determining whether a vendor which allows use of said image formation apparatus according to any value entered therein is connected to said image formation apparatus or not; and 2) inhibiting the power supply from turned off by said automatic power off function if it is determined that said vendor is connected in said step 1.

24. A method of controlling an image formation apparatus to which a vendor allowing use of said image formation apparatus according to any value entered therein is connected, and which has an automatic power off function which allows the power supply to be turned off automatically at a prescribed timing, comprising the steps of:

1) determining if there is any balance of the value entered in said vendor; and 2) inhibiting the power supply from turned off by said automatic power off function if it is determined that there is any balance of the value in said vendor in said step 1.

25. The method according to claim 24, wherein further comprising a step 3) of allowing the power supply to be turned off by said automatic power off function when said balance of the value in said vendor has been consumed.

26. A method of controlling an image formation apparatus to which a vendor allowing use of said image formation apparatus according to any value entered therein is connected, and which has an automatic power off function which allows a power supply to be turned off automatically at a prescribed timing, comprising the steps of:

1) determining whether any value is entered in said vendor; and 2) turning on said power supply of the image formation apparatus when it is determined that any value is entered in said vendor in said step 1.

* * * * *